US006780087B2

(12) United States Patent
Minegar

(10) Patent No.: US 6,780,087 B2
(45) Date of Patent: Aug. 24, 2004

(54) ABRASIVE TOOL ASSEMBLY

(76) Inventor: Kenneth F. Minegar, 5020 Cole St., San Diego, CA (US) 92117

( * ) Notice: Subject to any disclaimer, the term of this patent is extended or adjusted under 35 U.S.C. 154(b) by 137 days.

(21) Appl. No.: 10/194,858

(22) Filed: Jul. 12, 2002

(65) Prior Publication Data

US 2004/0009737 A1 Jan. 15, 2004

(51) Int. Cl.[7] ..... B24B 1/00

(52) U.S. Cl. ..... 451/28; 254/354; 254/524; 254/525

(58) Field of Search ..... 451/28, 351–357, 451/527, 525, 41, 358, 344, 523

(56) References Cited

U.S. PATENT DOCUMENTS

| | | | | |
|---|---|---|---|---|
| 2,361,683 A | | 10/1944 | Greenberg | |
| 2,854,829 A | | 10/1958 | Porter | |
| 3,999,869 A | | 12/1976 | Clark et al. | |
| 4,634,613 A | | 1/1987 | Potter | |
| 4,782,632 A | | 11/1988 | Matechuk | |
| 4,790,208 A | | 12/1988 | Johnson | |
| 4,890,422 A | | 1/1990 | Reiling et al. | |
| 5,108,235 A | | 4/1992 | Czyzewski | |
| 5,226,762 A | | 7/1993 | Ecker | |
| 5,349,786 A | * | 9/1994 | Dorrah | 451/357 |
| 5,690,452 A | | 11/1997 | Baublits | |
| 5,690,545 A | | 11/1997 | Clowers et al. | |
| 5,868,532 A | | 2/1999 | Spenser | |
| 5,885,145 A | | 3/1999 | O'Mara | |
| 6,116,999 A | * | 9/2000 | Montross | 451/524 |

* cited by examiner

*Primary Examiner*—Lee D. Wilson
(74) *Attorney, Agent, or Firm*—James P. Broder

(57) ABSTRACT

An abrasive tool assembly (10) for treating a surface can include a universally pivoting pad assembly (12), an adaptor assembly (14) and/or a rotational device (16). The adaptor assembly (14) transfers a rotational force of the rotational device (16) to the pad assembly (12) includes a shaft section (32), a threaded section (34) and one or more tighteners (36). The shaft section (32) is secured to the rotational device (16). The threaded section (34) is secured to the pad assembly (12). Each tightener (36) moves between a loosened position and a tightened position wherein the tightener frictionally secures the pad assembly (12) against the threaded section (34) of the adaptor assembly (14). In one embodiment, the threaded section (34) is externally threaded. In another embodiment, the threaded section (34) is internally threaded. The shaft section (32) has a longitudinal axis (47). In one embodiment, the tightener (36) moves between the loosened position and the tightened position in a direction that is non-perpendicular to the longitudinal axis (47) of the shaft section (32). In another embodiment the tightener (36) moves in a direction that is substantially parallel to the longitudinal axis (47).

30 Claims, 5 Drawing Sheets

ABRASIVE TOOL ASSEMBLY

FIELD OF THE INVENTION

The present invention relates generally to rotating abrasive tools such as sanders and polishers. More specifically, the present invention relates to an adaptor for a rotating abrasive tool.

BACKGROUND

In residential and commercial construction, use of an abrasive tool such as a sander or a polisher is commonplace. Specifically, sanding of floors, walls and ceilings is often performed to provide a consistently even surface that can accept paint, stain or wallpaper. FIG. 1A illustrates a prior art abrasive tool assembly 10P. This type of device is often used by contractors and home-improvers, and includes a pad assembly 12P and a threaded extension pole 13P, which is held by the user. The pad assembly 12P can include a universally pivoting connector region 22P having either internal threads 28P (illustrated in FIG. 1B), or external threads 29P (illustrated in FIG. 1C). The internal threads 28P or external threads 29P of the connector region 22P mate with the extension pole 13P having external or internal threads, respectively. Although this type of prior art abrasive tool assembly 10P can decrease the level of effort necessary to sand a surface, manually sanding a surface with this device can still require a substantial amount of time and physical exertion.

In light of the above, there is a need for providing a reliable, simple, and efficient method for sanding, polishing, or otherwise treating a surface. Still another need exists to provide a device used for sanding or polishing that can reduce the required effort level. Yet another need exists to provide an abrasive tool assembly that is relatively easy and cost effective to manufacture, assemble and use.

SUMMARY

The present invention is directed to an adaptor assembly for transferring a rotational force of a rotational device to a universally pivoting pad assembly. The adaptor assembly includes a shaft section that is received by the rotational device, a threaded section that receives the threaded region of the pad assembly, and one or more tighteners. Each tightener moves between a loosened position and a tightened position. In the tightened position, the tightener frictionally secures the threaded region of the pad assembly against the threaded section of the adaptor assembly. In one embodiment, the threaded section is externally threaded. Alternately, the threaded section is internally threaded.

Further, the shaft section has a longitudinal axis. In one embodiment, the tightener can move between the loosened position and the tightened position in a direction that is non-perpendicular to the longitudinal axis of the shaft section. In another embodiment the tightener can move between the loosened position and the tightened position in a direction that is substantially parallel to the longitudinal axis.

The present invention is further directed to an abrasive tool assembly including a pad assembly having a surface region that contacts a surface to be treated, and an adaptor assembly that is removably secured to the pad assembly. The adaptor assembly is adapted to be secured to the rotational device. With this design, the adaptor assembly transfers a rotational force from the rotational device to the pad assembly.

The present invention is also directed to a pad assembly and a method for sanding a surface.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
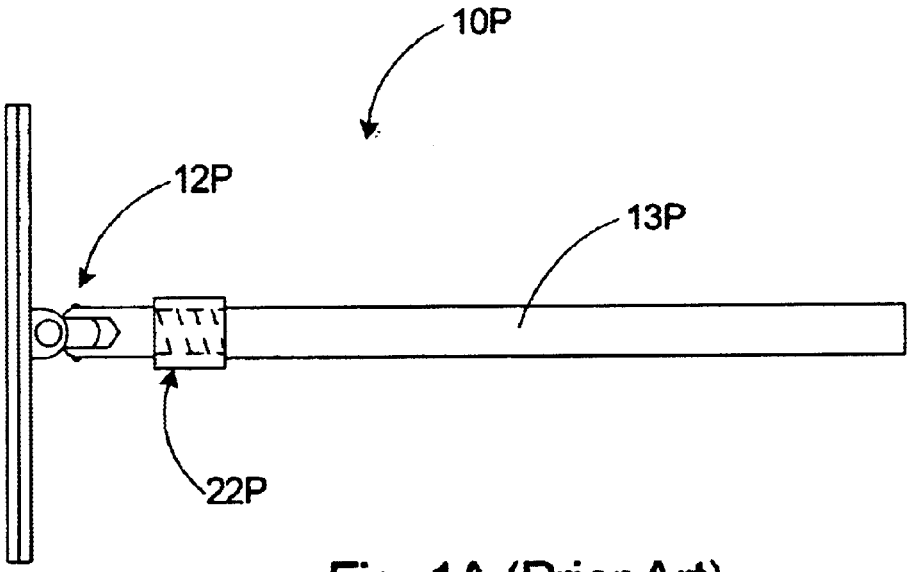
Fig. 1A (Prior Art)
FIG. 1A is a side view of a prior art device used for sanding including a pad assembly and an extension pole.
Figure 1B:
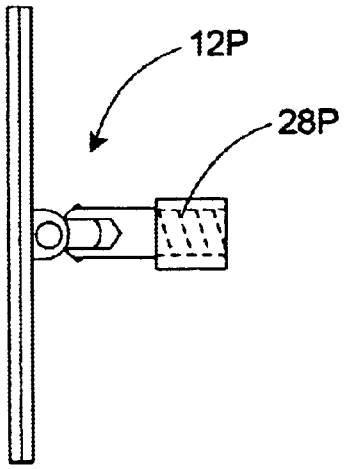
Fig. 1B (Prior Art)
FIG. 1B is a side view of a prior art pad assembly.
Figure 1C:
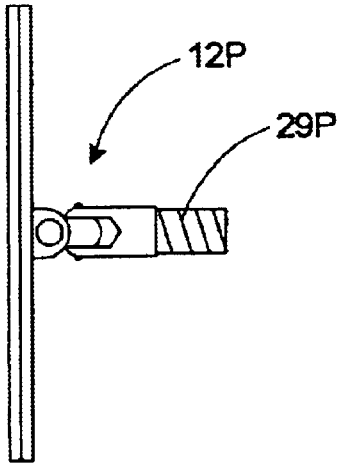
Fig. 1C (Prior Art)
FIG. 1C is a side view of another prior art pad assembly.
Figure 2A:
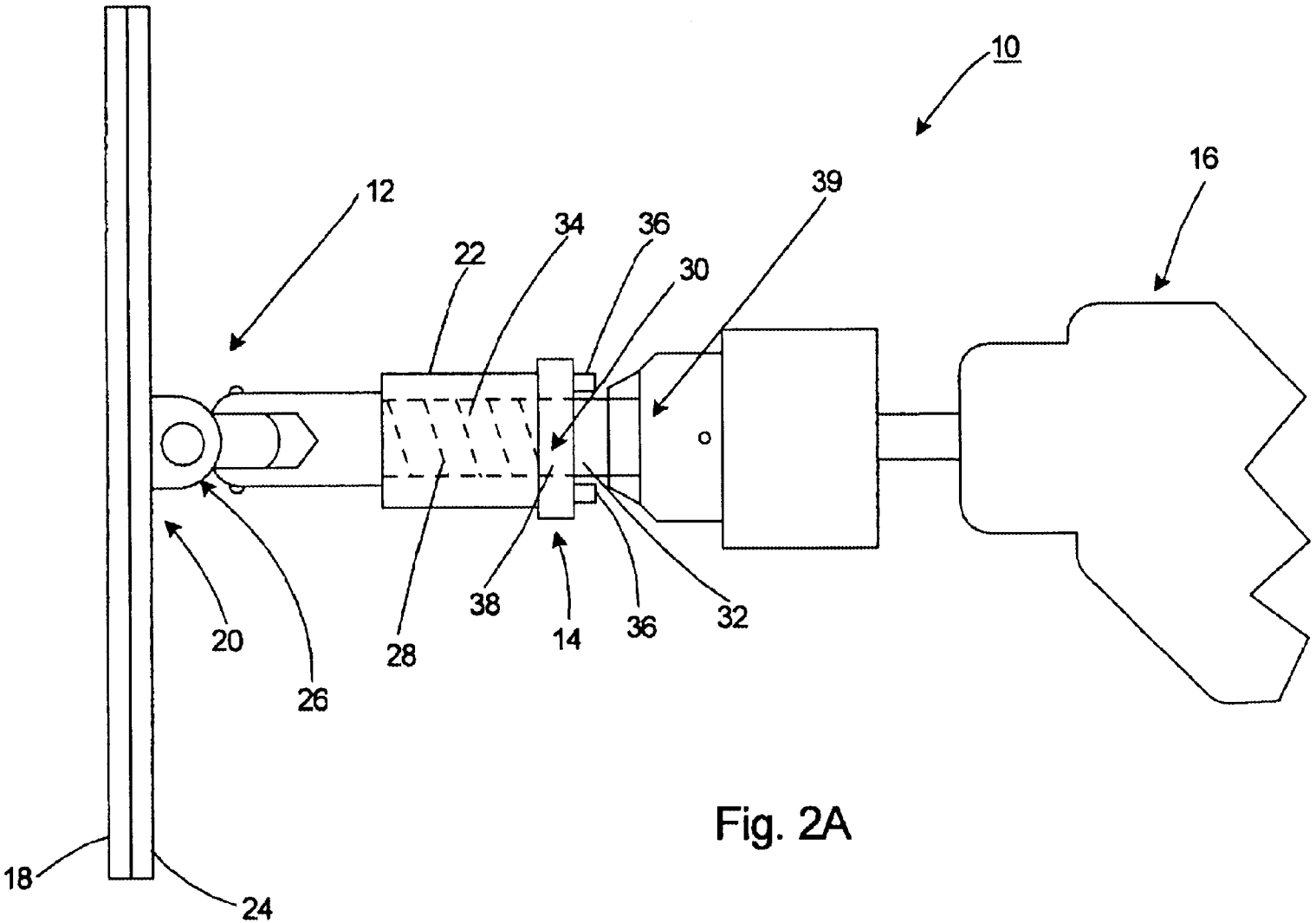
FIG. 2A is a side view of an embodiment of an abrasive tool assembly having features of the present invention.

FIG. 2A illustrates an abrasive tool assembly 10 having features of the present invention. In this embodiment, the abrasive tool assembly 10 includes a pad assembly 12, an adaptor assembly 14, and a rotational device 16. The adaptor assembly uniquely couples the pad assembly 12 to the rotational device 16.

The pad assembly 12 illustrated in FIG. 2A includes a surface region 18, a pad region 20 and a connector region 22. The surface region 18 rotatably contacts a surface (not shown) to be treated. The design of the surface region 18 can be varied. For example, the surface region 18 can include any abrasive or semi-abrasive material such as sandpaper that is attached, either temporarily or permanently, to the pad region 20. Alternately, the surface region 18 can include a polishing or buffing material, or any other suitable material that treats the surface as intended by the user. These polishing materials can include various synthetic fibrous materials, cotton, wool or any other appropriate material. The shape of the surface region 18 can vary widely. The surface region 18 can be rectangular, disk-shaped, hexagonal or triangular, as non-exclusive examples.

For instance, in embodiments wherein the surface region 18 is formed from sandpaper, the abrasive tool assembly 10 can be used to smooth surfaces such as drywall, wood, metal or other suitable surfaces. The surfaces that can be treated include floors, ceilings, walls, furniture, or any other surface of suitable dimensions to accommodate the present invention.

The pad region 20 provides a surface to which the surface region 18 can be secured. The design of the pad region 20 can be varied to suit the design requirements of the abrasive tool assembly 10 and the user. In the embodiment illustrated in FIG. 2A, the pad region 20 includes a pad section 24 and a pivot section 26. The pad section 24 supports the surface region 18. The pad section 24 can be formed from a resilient material to provide a somewhat padded surface. Utilizing a resilient material allows the surface region 18 to conform to the surface being treated to provide a more uniform treatment of the surface. As examples, the pad section 24 can be formed from various plastics, sponge materials or polyurethane materials. However, any suitable material can be used to form the pad section 24. Alternately, the pad section 24 can be formed from a non-resilient material.

The pivot section 26 is secured to the pad section 24. Further, the pivot section 26 couples the connector region 22 to the surface region 18. The pivot section 26 can allow universal pivoting of the connector region 22 relative to the pad section 24. In this embodiment, the pivot section 26 can include a universal pivot joint mechanism that is known by those skilled in the art.

The connector region 22 pivotally extends from the pivot section 26. The design of the connector region 22 can vary. In this embodiment, the connector region 22 includes internal threads 28. The internal threads 28 of the connector region 22 mate with the adaptor assembly 14 provided herein.

The adaptor assembly 14 couples the pad assembly 12 to the rotational device 16. The design of the adaptor assembly 14 can be varied to suit the design requirements of the pad assembly 12 and the rotational device 16. In the embodiment illustrated in FIG. 2A, the adaptor assembly 14 includes an adaptor 30 having a shaft section 32, a threaded section 34 (illustrated in phantom), one or more tighteners 36 and a contact section 38.

The rotational device 16 includes a chuck 39 that grips the shaft section 32 of the adaptor assembly 14. The rotational device 16 rotates the adaptor assembly 14, and thus the pad assembly 12, relative to the surface to be treated. The rotational device 16 can be any rotary drill that can receive the shaft section 32 of the adaptor assembly 14. For example, the rotational device 16 can be a handheld electric or battery-operated drill. However, any suitable rotary drill-type device can be used.

Figure 2B:
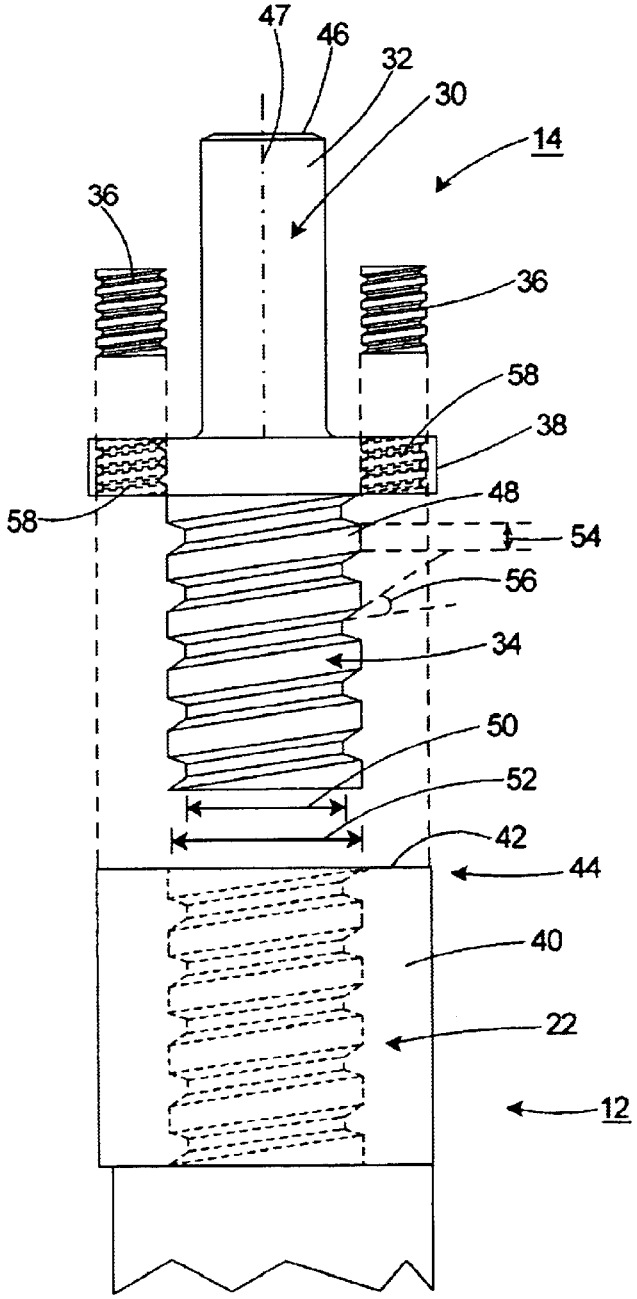
FIG. 2B is an exploded side view of a portion of the abrasive tool assembly illustrated in FIG. 2A including an adaptor assembly and a portion of a pad assembly.

FIG. 2B is an exploded view of a first embodiment of the adaptor assembly 14 and a portion of the pad assembly 12. In this embodiment, the adaptor assembly 14 includes the adaptor 30 which mates with connector region 22 of the pad assembly 12. As illustrated in FIG. 2B, the connector region 22 is internally threaded (illustrated in phantom), and can receive and mate with the threaded section 34 of the adaptor 30. The connector region 22 illustrated in FIG. 2B has a substantially circular cross-section, although other geometries can be utilized for the connector region 22. The connector region 22 also includes a connector wall 40 having a substantially circular collar 42 at a distal end 44 of the connector region 22.

The shaft section 32 of the adaptor 30 fits within the chuck 39 (illustrated in FIG. 2A) of the rotational device 16. The dimensions of the shaft section 32 can be varied depending upon the requirements of the rotational device 16. For example, the shaft section 32 can have a substantially circular cross-sectional shape which has a diameter of approximately 0.50 inches. However, the diameter of the shaft section 32 can be greater or less than 0.50 inches. Additionally, the cross-sectional shape of the shaft section 32 can be hexagonal, octagonal, triangular, or any other suitable geometry. Moreover, the shaft section 32 can include a beveled end 46 which facilitates insertion of the shaft section 32 into the chuck 39 of the rotational device 16.

The length of the shaft section 32 can also vary. In one embodiment, the length of the shaft section 32 is approximately 1.00 inches. The length can be greater or less than 1.00 inches, however. In addition, the shaft section 32 has a longitudinal axis 47.

The threaded section 34 illustrated in FIG. 2B includes external threads 48 that mate with the internal threads 28 of the connector region 22. The design of the threaded section 34 can vary. For example, the size of the threads 48, as well as the number of threads 48, can be varied to suit the design requirements of the pad assembly 12. In one embodiment, the threaded section 34 has a length that is approximately 0.95 inches. Alternately, the length of the threaded section 34 can be greater or less than 0.95 inches. Further, the threaded section 34 can have a minor diameter 50 of approximately 0.64 inches and a major diameter 52 of approximately 0.74 inches, although these dimensions can vary. Additionally, the threaded section 34 can include threads 48 having a thread width 54 that is approximately 0.07 inches, both at the minor diameter 50 and the major diameter 52. The threads 48 include a thread angle 56 between the minor diameter 50 and the major diameter 52 that is approximately 30 degrees, although the thread angle 56 can be greater or less than 30 degrees.

The adaptor 30 also includes one or more tighteners 36. In the embodiment illustrated in FIG. 2B, the adaptor 30 includes two tighteners 36. In this embodiment, each tightener 36 is a threaded set screw that is tightened against the collar 42 of the connector region 22 by the user following mating between the threaded section 34 of the adaptor 30 and the connector region 22 of the pad assembly 12. Each tightener 36 has a length sufficient to contact the connector region 22 once screwed through the contact section 38 of the adaptor 30. Each tightener 36 moves between a loosened position and a tightened position. In the loosened position, the tightener 36 does not contact the connector region 22. In the tightened position, the tightener 36 is tightened against the connector region 22. In one embodiment, the tightener 36 moves in a direction that is non-perpendicular to the longitudinal axis 47 of the shaft section 32. In an alternate embodiment, the tightener 36 moves in a direction that is substantially parallel to the longitudinal axis 47 of the shaft section 32.

With the design provided herein, the adaptor 30 will be securely mated with the connector region 22 and will be less susceptible to loosening during either clockwise or counterclockwise rotation of the adaptor 30 by the rotational device 16. Stated another way, a frictional force is generated between the threaded section 34 of the adaptor 30 and the threads 28 of the connector region 22 by tightening the set screws against the collar 42 of the connector region 22. This frictional force inhibits rotational movement of the adaptor 30 relative to the connector region 22, resulting in a secure attachment. In alternate embodiments, the adaptor 30 can include one tightener 36, or greater than two tighteners 36.

The contact section 38 inhibits movement between the adaptor 30 and the connector region 22. For instance, the contact section 38 can abut the collar 42 of the connector region 22 during mating between the adaptor 30 and the connector region 22 of the pad assembly 12. Alternatively, the contact section 38 need not abut the collar 42. The shape and size of the contact section 38 can be varied depending upon the design requirements of the pad assembly 12. For example, the contact section 38 can be substantially circular in shape, and can have a diameter that is at least as great as a diameter of the collar 42 of the connector region 22, as illustrated in FIG. 2B. Alternately, the contact section 38 can have any shape that can accommodate the tighteners 36. In the embodiment illustrated in FIG. 2B, the contact section 38 includes two threaded apertures 58 (illustrated in phantom) through which the tighteners 36 penetrate during tightening. The number of apertures 58 can vary, but is preferably greater than or equal to the number of tighteners 36.

The adaptor 30 can be formed from sufficiently rigid materials such as metals, durable plastics, epoxy resins or other suitable materials. For example, the adaptor 30 can be formed from aluminum, zinc alloy or other alloys. The adaptor 30 can be formed by casting or milling, as non-exclusive examples. Further, the shaft section 32, the threaded section 34 and/or the contact section 38 of the adaptor 30 can be formed as a unitary structure. Alternately, one or more sections 32, 34, 38 can be separately formed and secured to the other sections 32, 34, 38.

Figure 2C:
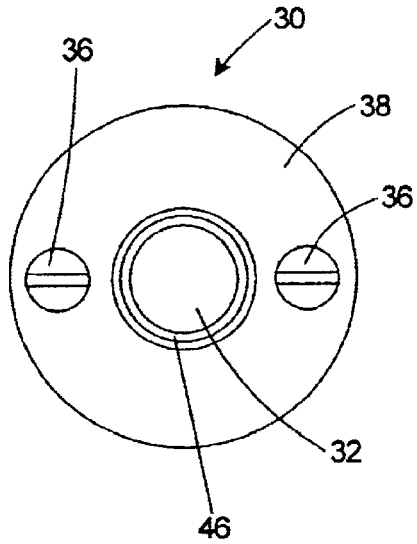
FIG. 2C is an end view of the adaptor assembly illustrated in FIG. 2B.

FIG. 2C is an end view of the adaptor 30 shown in FIG. 2B, as viewed from the shaft section 32. FIG. 2C illustrates an example of the relative positioning of the shaft section 32 having the beveled end 46, the tighteners 36 and the contact section 38.

Figure 3A:
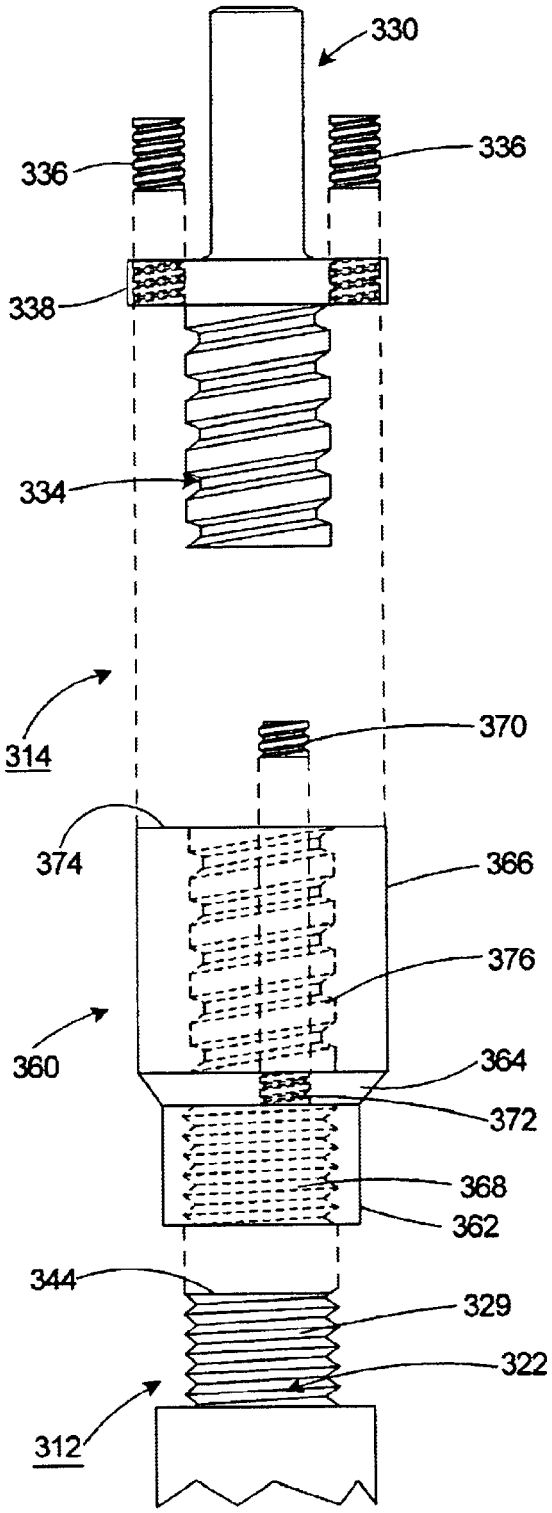
FIG. 3A is an exploded side view of a portion of another embodiment of the abrasive tool assembly having features of the present invention including an adaptor assembly and a portion of a pad assembly.

FIG. 3A is an exploded view of second embodiment of the adaptor assembly 314 and a portion of the pad assembly 312. In this embodiment, the adaptor assembly 314 includes an adaptor 330 and a coupler 360. The coupler 360 couples the adaptor 330 to a connector region 322 of the pad assembly 312. As illustrated in FIG. 3A, the connector region 322 includes external threads 329. The connector region 322 of the pad assembly 312 illustrated in FIG. 3A has a substantially circular cross-section, although other geometries can be utilized for the connector region 322.

The adaptor 330 illustrated in FIG. 3A is substantially similar to the adaptor 30 described previously relative to FIG. 2B.

The design of the coupler 360 can vary depending upon the requirements of the adaptor 330 and the pad assembly 312. In the embodiment illustrated in FIG. 3A, the coupler 360 includes a first coupler end 362, an intermediate region 364 and a second coupler end 366. The first coupler end 362 includes internal threads 368 (illustrated in phantom) that mate with the external threads 329 of the connector region 322.

The intermediate region 364 of the coupler 360 includes an externally threaded coupler tightener 370 and an internally threaded coupler tightener aperture 372 (illustrated in phantom). The coupler tightener 370 removably mates with coupler tightener aperture 372. In the embodiment illustrated in FIG. 3A, the coupler 360 includes one coupler tightener 370. In this embodiment, the coupler tightener 370 is a threaded set screw that is tightened against a distal end 344 of the connector region 322 by the user following mating between the internal threads 368 of the first coupler end 362 and the connector region 322 of the pad assembly 312. The set screw has a length sufficient to contact the distal end 344 of the connector region 322 once screwed through the coupler tightener aperture 372 of the coupler 322. With this design, the coupler 360 will be securely mated with the connector region 322 and will be less susceptible to loosening during either clockwise or counterclockwise rotation of the adaptor assembly 314 by the rotational device 16 (illustrated in FIG. 2A). Stated another way, a frictional force is generated between the internal threads 368 of the first coupler end 362 and the external threads 329 of the connector region 322 by tightening the set screw against the distal end 344 of the connector region 322. This frictional force inhibits rotational movement of the adaptor assembly 314 relative to the connector region 322, resulting in a secure attachment. In alternate embodiments, the coupler 360 can include greater than one coupler tightener 370.

The second coupler end 366 includes a coupler collar 374, and internal threads 376 (illustrated in phantom) that mate with a threaded section 334 of the adaptor 330. One or more tighteners 336 are tightened against the coupler collar 374 by the user following mating between the threaded section 334 of the adaptor 330 and the second coupler end 366. Each tightener 336 has a length sufficient to contact the coupler collar 374 once screwed through the contact section 338 of the adaptor 330. With this design, the adaptor 330 will be securely mated with the coupler 360 and will be less susceptible to loosening during either clockwise or counterclockwise rotation of the adaptor 330 by the rotational device 316. Stated another way, a frictional force is generated between the threaded section 334 of the adaptor 330 and the internal threads 376 of the second coupler end 366 by tightening the tighteners 336 against the coupler collar 374 of the second coupler end 366. This frictional force inhibits rotational movement of the adaptor 330 relative to the coupler 360, resulting in a secure attachment. In alternate embodiments, the adaptor 330 can include one tightener 336, or greater than two tighteners 336.

Further, the contact section 338 inhibits movement between the adaptor 330 and the coupler 360. For instance, the contact section 338 can abut the coupler collar 374 of the second coupler end 366 during mating between the adaptor 330 and the coupler 360. Alternatively, the contact section 338 need not abut the coupler collar 374. The contact section 338 can have a diameter that is at least as great as a diameter of the coupler collar 374. Alternately, the diameter of the contact section 338 can be less than or equal to the diameter of the coupler collar 374.

The coupler 360 can be formed from sufficiently rigid materials such as metals, durable plastics, epoxy resins or other suitable materials. For example, the coupler 360 can be formed from aluminum, zinc alloy or other alloys. The coupler 360 can be formed by casting or milling, as non-exclusive examples. Further, the first coupler end 362, the intermediate region 364 and/or the second coupler end 366 of the coupler 360 can be formed as a unitary structure. Alternately, one or more of these sections 362, 364, 366 can be separately formed and secured to the other sections 362, 364, 366.

Figure 3B:
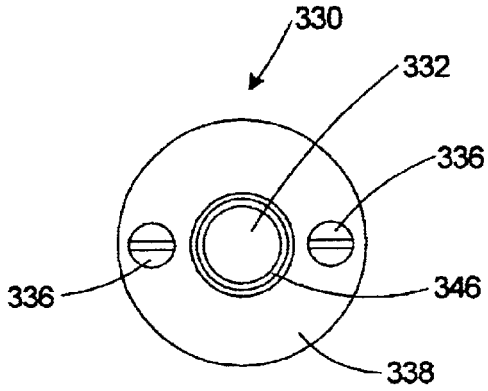
FIG. 3B is an enlarged end view of a portion of the adaptor assembly illustrated in FIG. 3A.

FIG. 3B illustrates an end view of the adaptor 330 shown in FIG. 3A, including an example of the relative positioning of the shaft section 332 having the beveled end 346, the tighteners 336 and the contact section 338.

Figure 3C:
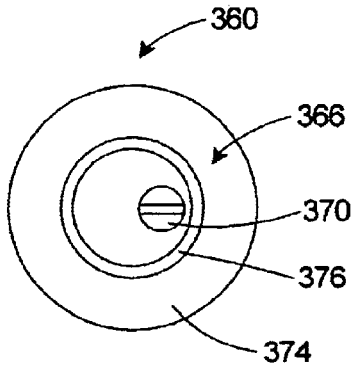
FIG. 3C is an enlarged end view of another portion of the adaptor assembly illustrated in FIG. 3A.

FIG. 3C illustrates an end view of the coupler 360, as viewed from the second coupler end 366. FIG. 3C shows an example of the relative positioning of the coupler tightener 370, the internal threads 376 of the second coupler end 366 and the coupler collar 374, although this positioning can be varied.

Figure 4:
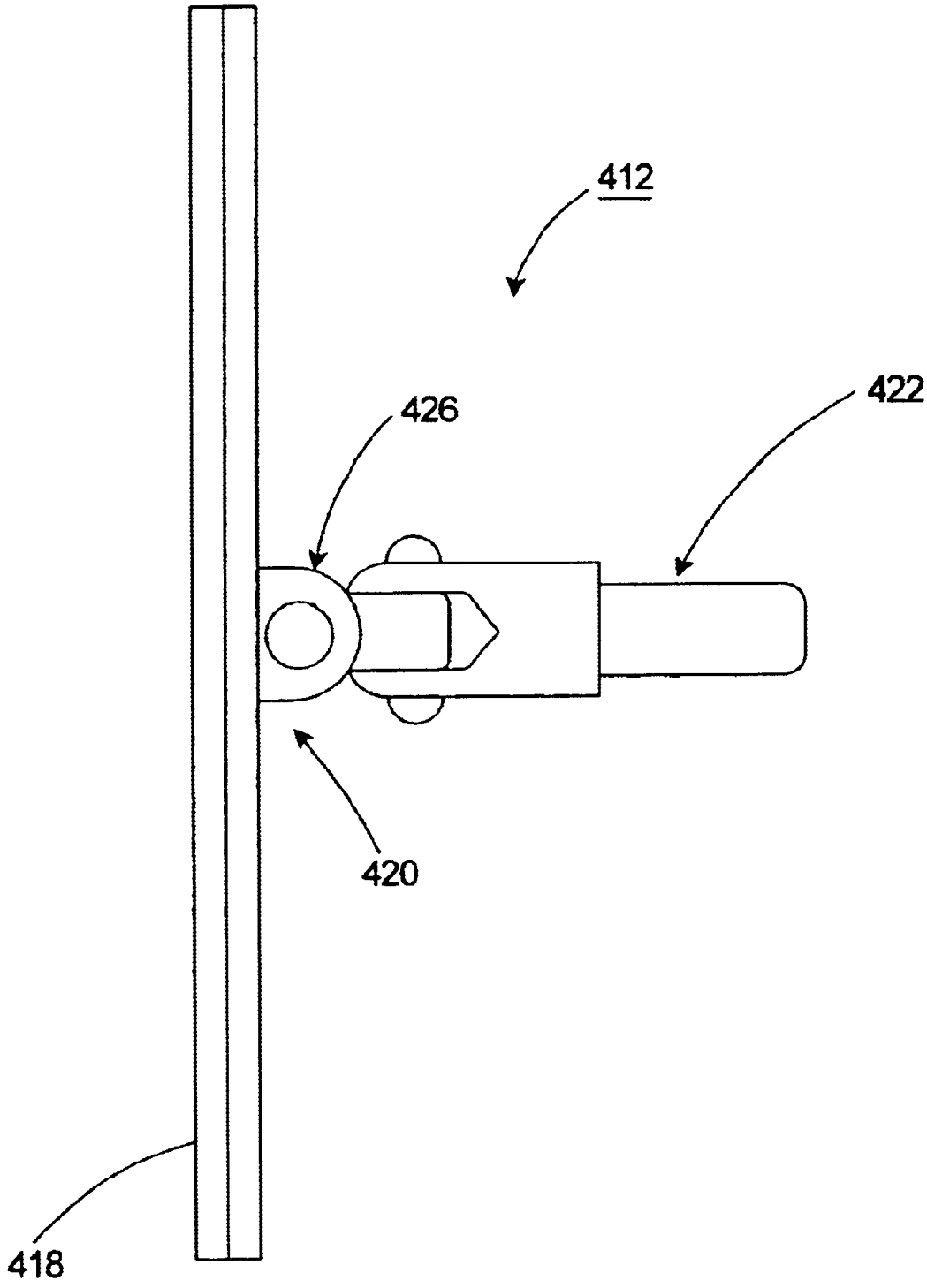
FIG. 4 is a side view of an abrasive tool assembly having features of the present invention.

FIG. 4 illustrates a side view of an alternate embodiment of the pad assembly 412. In this embodiment, the pad assembly 412 includes a surface region 418, a pad region 420 and a connector region 422. The surface region 418 and the pad region 420 are substantially similar to those previously described relative to FIG. 2A. The connector region 422 pivotally extends from a pivot section 426 of the pad region 420. The design of the connector region 422 can vary. In the embodiment illustrated in FIG. 4, the connector region 422 is not threaded. Instead, the connector region 422 is shaped and sized to be inserted directly into the chuck of a rotational device 16 (illustrated in FIG. 2A). Thus, in this embodiment, the adaptor assembly 14 is omitted from the abrasive tool assembly 410, which includes only the pad assembly 412 and the rotational device 16.

The abrasive tool assembly 10 described herein permits sanding or other treatment of the desired surface with reduced physical exertion. Moreover, with this design, the abrasive tool assembly 10 can be quickly assembled with minimal effort.

While the particular abrasive tool assembly 10 as shown and disclosed herein is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An adaptor assembly for transferring a rotational force of a rotational device to a universally pivoting pad assembly, the pad assembly including a connector region having a distal end, the adeptor assembly comprising:

a shaft section that is adapted to be received by the rotational device:

a threaded section that is externally threaded, the threaded section threadedly engaging the connector region of the universally pivoting pad assembly; and a tightener that moves between a loosened position and a tightened position, the tightener frictionally securing the connector region of the pad assembly against the threaded section of the adaptor assembly when the tightener is in the tightened position.

2. An adaptor assembly for transferring a rotational force of a rotational device to a universally pivoting pad assembly, the pad assembly including a pad section and a pivot section that universally pivots relative to the pad section, the pivot section including a connector region having a threaded distal end, the adaptor assembly comprising:

a shaft section that is received by the rotational device;

a threaded section that threadedly engages the distal end of the connector region of the universally pivoting pad assembly; and a threaded first tightener that is positioned off-center relative to the shaft section, the first tightener moving between (i) a loosened position wherein the first tightener does not exert a force against the distal end of the connector region, and (ii) a tightened position wherein the first tightener exerts a force against the distal end of the connector region so that the connector region frictionally engages the threaded section of the adaptor assembly.

3. The adaptor assembly of claim 2 wherein the threaded section is externally threaded.

4. The adaptor assembly of claim 2 further comprising a threaded second tightener that moves between (i) a loosened position wherein the second tightener does not exert a force against the distal end of the connector region, and (ii) a tightened position wherein the second tightener exerts a force against the distal end of the connector region so that the connector region frictionally engages the threaded section of the adaptor assembly.

5. The adaptor assembly of claim 4 wherein the second tightener is positioned off-center relative to the shaft section.

6. The adaptor assembly of claim 2 wherein the shaft section has a longitudinal axis, and wherein the first tightener moves between the loosened position and the tightened position in a direction that is substantially non-perpendicular to the longitudinal axis.

7. The adaptor assembly of claim 2 further comprising a contact section that contacts the connector region of the pad assembly when the first tightener is in the tightened position, the first tightener extending through the contact section when the first tightener is in the tightened position.

8. The adaptor assembly of claim 2 wherein the first tightener is externally threaded.

9. The adaptor assembly of claim 2 wherein the threaded section is internally threaded.

10. An abrasive tool assembly including (i) a pad assembly that includes a universal pivot, and (ii) the adaptor assembly of claim 2, the pad assembly being removably secured to the threaded section of the adaptor assembly.

11. An adaptor assembly for transferring a rotational force of a rotational device to a universally pivoting pad assembly, the pad assembly including a pad section and a pivot section that universally pivots relative to the pad section, the pivot section including a connector region having a threaded distal end, the adaptor assembly comprising:

a shaft section that is received by the rotational device;

a threaded section that threadedly engages the distal end of the connector region of the universally pivoting pad assembly; and an externally threaded first tightener that moves between (i) a loosened position wherein the first tightener does not exert a force against the distal end of the connector region, and (ii) a tightened position wherein the first tightener forces the distal end of the connector region to frictionally engage the threaded section of the adaptor assembly.

12. The adaptor assembly of claim 11 wherein the first tightener is positioned off-center relative to the shaft section.

13. The adaptor assembly of claim 11 wherein the threaded section is externally threaded.

14. The adaptor assembly of claim 11 wherein the threaded section is internally threaded.

15. The adaptor assembly of claim 11 further comprising a threaded second tightener that moves between (i) a loosened position wherein the second tightener does not exert a force against the distal end of the connector region, and (ii) a tightened position wherein the second tightener exerts a force against the distal end of the connector region so that the connector region frictionally engages the threaded section of the adaptor assembly.

16. The adaptor assembly of claim 15 wherein at least one of the tighteners is positioned off-center relative to the shaft section.

17. The adaptor assembly of claim 11 further comprising a contact section that contacts the connector region of the pad assembly when the first tightener is in the tightened position, the first tightener extending through the contact when the first tightener is in the tightened position.

18. The adaptor assembly of claim 11 wherein the shaft section has a longitudinal axis, and wherein the first tightener moves between the loosened position and the tightened position in a direction that is substantially non-perpendicular to the longitudinal axis.

19. An abrasive tool assembly including (i) a pad assembly that includes a universal pivot, and (ii) the adaptor assembly of claim 11, the pad a assembly being removably secured to the threaded section of the adaptor assembly.

20. An adaptor assembly for transferring a rotational force of a rotational device to a universally pivoting pad assembly, the pad assembly including a pad section and a pivot section that universally pivots relative to the pad section, the pivot section including a connector region having a threaded distal end, the adaptor assembly comprising:

a shaft section that is received by the rotational device;

a threaded section that threadedly engages the distal end of the connector region of the universally pivoting pad assembly;

a contact section that contacts the distal end of the connector region; and a first tightener that extends through the contact section, the first tightener moving between (i) a loosened position wherein the first tightener does not contact the connector region, and (ii) a tightened position wherein the first tightener exerts a force against the distal end of the connector region to frictionally engage the threaded section of the adaptor assembly with the connector region.

21. The adaptor assembly of claim 20 wherein the first tightener is positioned off-center relative to the shaft section.

22. The adaptor assembly of claim 20 wherein the threaded section is externally threaded.

23. The adaptor assembly of claim 20 wherein the threaded section is internally threaded.

24. The adaptor assembly of claim 20 further comprising a threaded second tightener that moves between (i) a loosened position wherein the second tightener does not exert a force against the distal end of the connector region, and (ii) a tightened position wherein the second tightener exerts a force against the distal end of the connector region so that the connector region frictionally engages the threaded section of the adaptor assembly.

25. The adaptor assembly of claim 20 wherein the shaft section has a longitudinal axis, and wherein the first tightener moves between the loosened position and the tightened position in a direction that is substantially non-perpendicular to the longitudinal axis.

26. An abrasive tool assembly including (i) a pad assembly that includes a universal pivot, and (ii) the adaptor assembly of claim 20, the pad assembly being removably secured to the threaded section of the adaptor assembly.

27. A method for transferring a rotational force of a rotational device to a universally pivoting pad assembly, the method comprising the steps of:

threadedly engaging a connector region of the universally pivoting pad assembly with a threaded section of an adaptor assembly;

securing a shaft section of the adaptor assembly to the rotational device; and exerting a force against the connector assembly using a threaded tightener that is positioned off-center relative to the shaft section, the force causing the connector region to engage the threaded section of the adaptor assembly to inhibit relative movement between the adaptor assembly and the connector region.

28. The method of claim 27 wherein the tightener is externally threaded.

29. The method of claim 27 wherein the threaded section is externally threaded.

30. The method of claim 27 wherein the step of exerting a force includes extending the tightener through a contact section of the adaptor assembly, the contact section contacting the connector region of the pad assembly.

* * * * *